United States Patent [19]

DiBianca

[11] Patent Number: 4,901,100

[45] Date of Patent: Feb. 13, 1990

[54] SINGLE PASS COLOR HIGHLIGHTING COPYING SYSTEM

[75] Inventor: Anthony J. DiBianca, Downingtown, Pa.

[73] Assignee: Xerox Corporation, Stamford, Conn.

[21] Appl. No.: 233,408

[22] Filed: Aug. 18, 1988

[51] Int. Cl.[4] ..... G03G 15/01

[52] U.S. Cl. ..... 355/328; 355/219; 355/228

[58] Field of Search ..... 355/328, 266, 228, 219; 346/157, 160

[56] References Cited

U.S. PATENT DOCUMENTS

| | | | |
|---|---|---|---|
| 3,702,483 | 11/1972 | Fantuzzo | 346/74 ES |
| 3,914,043 | 10/1975 | McVeigh | 355/4 |
| 4,236,809 | 12/1980 | Kermisch | 355/4 |
| 4,582,417 | 4/1986 | Yagasaki et al. | 355/7 |
| 4,587,536 | 5/1986 | Saito et al. | 346/160 |
| 4,674,861 | 6/1987 | Kawamura | 355/40 |
| 4,727,382 | 2/1988 | Negishi et al. | 346/108 |
| 4,731,634 | 3/1988 | Stark | 355/328 |

*Primary Examiner*—R. L. Moses

*Attorney, Agent, or Firm*—H. Fleischer; J. E. Beck; R. Zibelli

[57] ABSTRACT

An apparatus in which a copy of an original document has selected portions thereof color highlighted. An editing device, associated with an electrophotographic printing machine, selects the portions of the copy to be reproduced in a highlight color with the remainder of the copy being reproduced in another color. The printing machine, in response to the signal transmitted from the edit pad, records a latent image on a photoconductive surface having a plurality of charge levels. These charge levels are developed simultaneously with different color developer material. The resultant developed image has different colors therein. This developed image is transferred to a copy sheet and fused thereto forming a color highlighted copy.

17 Claims, 4 Drawing Sheets

SINGLE PASS COLOR HIGHLIGHTING COPYING SYSTEM

This invention relates generally to electrophotographic printing, and more particularly concerns an information data editor for designating selected areas of an original to be reproduced in a highlight color by an electrophotographic printing machine associated therewith.

Generally, an electrophotographic printing machine forms successive copies of an original document. Recent printing machines are also designed to reproduce an identical copy of the original document and an altered copy of the original document. Thus, the printing machine will erase unnecessary data on the original document and add new data thereto. In this way, the printing machine performs an information data editing function which significantly reduces the labor and time in preparing revised copies from an existing original document. In electrophotographic printing, a latent image is recorded on a photoconductive surface, developed, and the resultant powder image transferred to a copy sheet. The powder image is then fused to the copy sheet. The latent image of the original document is formed by scanning the original document and projecting a light image thereof onto the charged portion of the photoconductive surface so as to selectively discharge the charge thereon. The latent image is edited by superimposing thereover an electrically modulated beam, such as a modulated laser beam, or the like. The modulated laser beam adds additional information or erases information from the latent image. In this way, the resultant copy is altered from the original document. Various techniques have been devised for transmitting an electrical signal to modulate the laser so as to record the desired information on the latent image. By way of example, the Panasonic E2S copier system uses an electronic pad to edit, move or delete information on a copy, and the Panasonic electronic print board allows information recorded on a blackboard sized electronic board to be copied automatically by a copying machine on a copy sheet. In order to define the area that is to be altered, the coordinates of the original document to be modified must be transmitted to the printing machine. Similarly, the NP 3525 Copier manufactured by the Canon Corporation employs an edit pad which enables selected portions of a copy to be color highlighted or deleted.

The basic technique of electrophotographic may adapted to produce color reproductions. In a typical multi-color electrophotographic printing machine, the light image is filtered to record an electrostatic latent image on the photoconductive surface corresponding thereto. The latent image is then developed with toner particles complimentary in color to the filtered light image. The toner powder image is then transferred to a sheet of support material. This process is repeated for successive differently colored light images. The multi-layered toner powder image is then fused to the sheet. With the development of multi-color electrophotographic printing, it has become desirable to create copies having selected portions thereof color highlighted. For example, portions of the original document may be selected and reproduced on the copy in a color different than that of the remaining document. A color highlighting system of this type is particularly useful in emphasizing particular paragraphs or portions of the original document in the copy. For example, a selected paragraph or line can be highlighted in red or blue with remainder of the copy being reproduced in black. Generally, multi-color and highlight color reproduction systems require a plurality of cycles to achieve the requisite colors. A copy having a single highlight color usually requires two cycles. During the first cycle one color is developed and transferred to the copy with the other color being transferred to the copy during the next cycle. The ability of the system to only reproduce one color during each cycle significantly reduces productivity and increases cost. This has led to single pass highlight color copying. In a single pass highlight color copier, two different charge levels are recorded on the photoconductive surface. Each charge level is then developed with differently colored toner particles during the same cycle. In this way, a paragraph or line of the latent image of a document can have one charge level with the remainder of the latent image being at another charge level. The paragraph or line of the latent image can be developed with red or blue toner particles while the remainder of the document is being developed with black toner particles. This results in the latent image being developed with toner particles of two different colors during one cycle. The resultant powder image is then transferred to the copy sheet and fused thereto. However, to date, it has been extremely difficult to select portions of the document to be reproduced in the highlight color and to set the charge levels of the latent image to correspond thereto. Various techniques have been devised for editing copies of an original document and reproducing selected portions of the original in a highlight color. The following disclosures appear to be relevant:

U.S. patent application Ser. No. 3,702,483
Patentee: Fantuzzo
Issued: Nov. 7, 1972
U.S. patent application Ser. No. 3,914,043
Patentee: McVeigh
Issued: Oct. 21, 1975
U.S. patent application Ser. No. 4,236,809
Patentee: Kermisch
Issued: Dec. 2, 1980
U.S. patent application Ser. No. 4,582,417
Patentee: Yagasaki et al.
Issued: Apr. 15, 1986
U.S. application Ser. No. 4,587,536
Patentee: Saito et al.
Issued: May 6, 1986
U.S. patent application Ser. No. 4,674,861
Patentee: Kawamura
Issued: Jul. 23, 1987
U.S. patent application Ser. No. 4,727,382
Patentee: Negishi et al.
Issued: Feb. 23, 1987

The disclosures of the above-identified patents may briefly summarized as follows:

U.S. patent application Ser. No. 3,702,483 discloses an electrophotographic printing machine having two different charge levels recorded on a photoconductive surface. The charge levels are developed with different color toner particles.

U.S. patent application Ser. No. 3,914,043 describes a selector which enables selected portions of a copy to be reproduced in one color with the remaining potions thereof being reproduced in another color.

U.S. patent application Ser. No. 4,236,809 discloses a low resolution correction apparatus. An electrostatic latent image of an original document is generated with a lamp system. The latent image is corrected for tone or color by a raster input scanner. The intensity of a laser beam on the pixel elements of a photoconductive surface is varied as a function of the correction signal.

U.S. patent application Ser. No. 4,582,417 describes an editing device for selecting portions of an original document and erasing the selected portions on the copy.

U.S. patent application Ser. No. 4,587,536 discloses an image recording apparatus with color detection. Color detecting units identify the colors of information to be recorded. Surface potential control is obtained by forming a pattern with dark and light areas on a photosensitive drum. A surface potential sensor detects the desired potentials by controlling the output power of chargers with a digital computer.

U.S. patent application Ser. No. 4,674,861 describes an image processing apparatus in which color information of text is displayed on a digitizer. The zones and colors of the regions specified by a pen are stored in the memory of a computer and supplied to a laser beam printer. The laser beam printer uses four photoconductive drums with each drum developing its'respective latent image with different color developer material. The developed images are transferred from the respective drums to a common sheet in superimposed registration with one another.

U.S. patent application Ser. No. 4,727,382 discloses an intensity control device for a laser used in a laser beam printer.

In accordance with one aspect of the present invention, there is provided a copy system, including input means for inputting a color highlighting condition for image editing. A copying machine is coupled to the input means. Image forming means, installed in the copying machine, form a copy image of an original being edited in accordance with the color highlighting condition. The copy image has a plurality of different charge levels with a first charge level corresponding to a first region of the copy image to be developed with developer material of a first color and a second charge level corresponding to a second region of the copy image to be developed with developer material of a second color.

Pursuant to another aspect of the present invention, there is provided an apparatus for producing a color highlighted copy of an original document. The apparatus includes means for reproducing copies of an original document. Means, located remotely from the reproducing means, designate selected portions of the original document to be color highlighted and generate a signal indicative of the portions of the original document to be color highlighted. Means, mounted in the reproducing means, form a latent image of the original document. The forming means is responsive to the signal from the designating means so that the latent image has at least two charge levels with a first charge level corresponding to a first region of the latent image to be developed with developer material of a first color and a second charge level corresponding to a second region of the latent image to be developed with developer material of a second color.

Other aspects of the present invention will become apparent as the following description proceeds and upon reference to the drawings, in which.

While the present invention will hereinafter be described in connection with various embodiments thereof, it will be understood that it is not intended to limit the invention to these embodiments. On the contrary, it is intended cover all alternatives, modifications and equivalents as may be included within the spirit and scope of the invention as defined by the appended claims.

Figure 1:
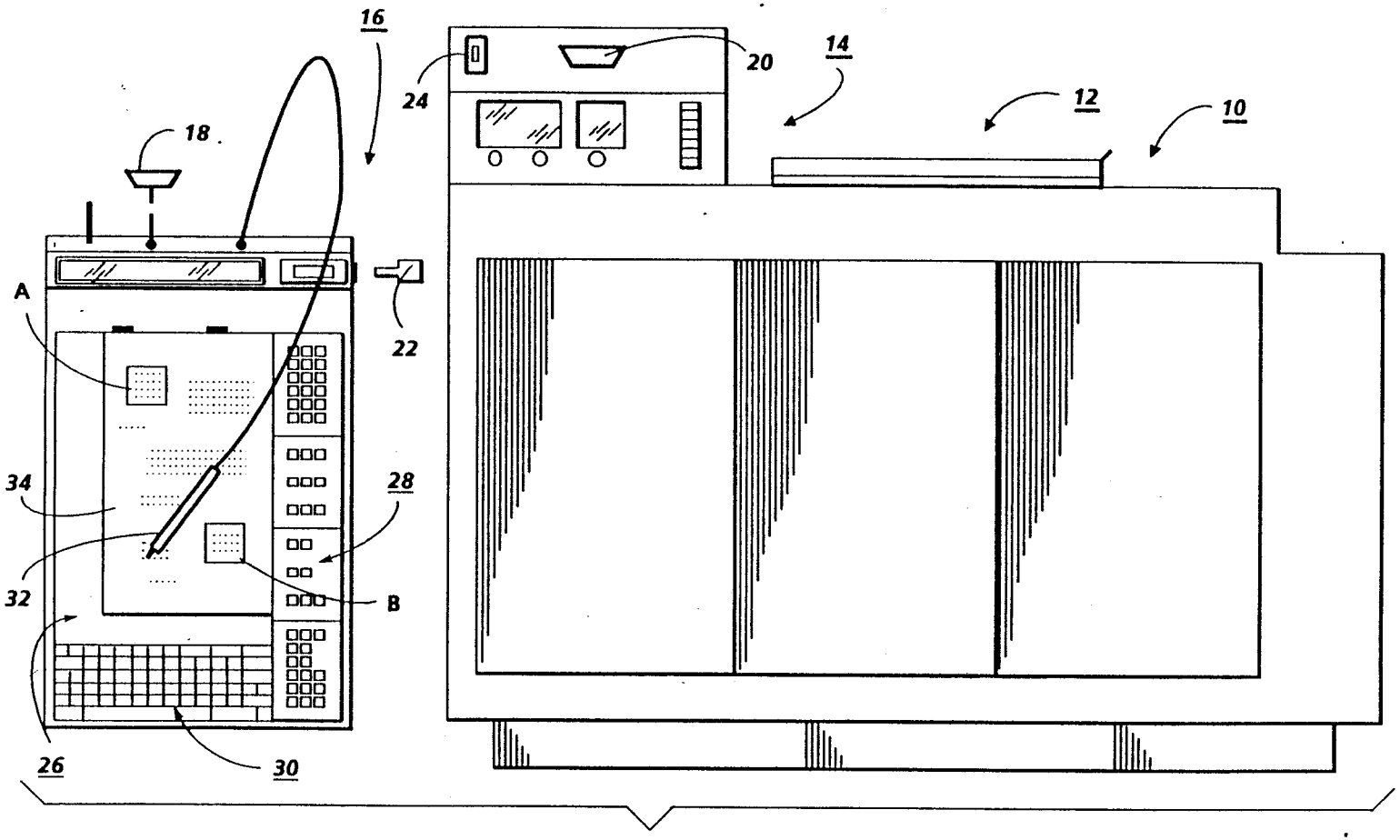
FIG. 1 is a schematic elevational view depicting a copying system having electrophotographic printing machine associated with an edit pad for producing single pass highlight color copies.

For a general understanding of the features of the present invention, reference is made to the drawings. In the drawings, like reference numerals have been used throughout to designate identical elements. FIG. 1 schematically depicts the copying system comprising an electrophotographic printing machine for reproducing copies and an edit pad for selecting those portions of the original document to be reproduced in a highlight color. It will become evident from the following discussions that many variations of the present invention are possible. For example, the edit pad can also be a computer video screen with a keyboard input for area designation. The features of the present invention are not intended to be specifically limited in their application to the particular embodiments depicted herein.

Referring now to FIG. 1 of the drawings, the copying system and its operation will be described with reference thereto. The electrophotographic printing machine, generally designated by the reference numeral 10, is capable of producing a stream of copy sheets having information copied on one side only, simplex sheets or on both sides, duplex sheets. A recirculating document feeder 12 is shown positioned above a platen (not shown) at the imaging station of printing machine 10. Document feeder 12 is adapted to feed original documents, in seriatim, to the platen for copying. Document feeder 12 usually operates in a collating mode in which original documents are fed, in seriatim, from a stack in a tray at the top of the feeder to the platen for copying one at a time for each circulation and then returned to the stack. The original documents are placed in the feeder in a predetermined, page sequential order. The machine operator can control the operation of the printing machine and its related apparatus through the operator control panel, designated generally by the reference numeral 14, and the edit pad, designated generally by the reference numeral 16. If desired, the recirculating document handling unit may be pivoted in an upward direction while the machine operator manually places an original document on the platen of the printing machine. In this mode of operation, the recirculating document handler is inoperative. Edit pad 16 is connected to the electrophotographic printing machine by an RS232 or similar connector 18 which plugs into adapter 20 on control panel 14 of printing machine 10. If the edit pad is located in a distant location from printing machine 10, the changes in the copy are stored in a portable memory key 22 which is initially positioned in edit pad 16 to store the requisite changes. Thereafter, memory key 22 is inserted into the receptacle 24 in control panel 14 of printing machine 10 so as to control the printing machine to form the highlight color regions of the copy. Edit pad 16 includes a digitizing area indicated generally by the reference numeral 26, an adjacent menu selection area, indicated generally by the reference numeral 28, and a keyboard area, indicated generally by the reference numeral 30. The original document is positioned in the digitizing area and the coordinates of the original document desired to be color highlighted are identified by positioning stylus 32 in contact therewith. In this way, positional coordinate information is transmitted either directly to the printing machine through the RS232 channel, indicated by the reference numeral 18, or to memory key 22. In either case, any suitable digitizer may be employed. Suitable digitizing schemes are disclosed in U.S. Pat. Nos. 4,368,351; 4,368,352; and 4,243,843, the relevant portions thereof are hereby being incorporated into the present application. Menu selection area 28 includes a plurality of editing, and job programming features which may be actuated by locating the stylus 32 in contact with the selected block. Positioning the stylus 32 in contact with the selected block in menu selection area 28 defines the operation to be performed on the selected text within the original document. Alternatively, additional text may be furnished to the original document by selecting the appropriate block in the menu selection area and typing in the desired information by selecting the keys of keyboard area 30 with stylus 32. One skilled in the art will appreciate that a conventional typing keyboard may be employed in lieu of a keyboard area actuated by stylus 32. The information being added to the copy of the original document is displayed on display 34 which is a forty character, two line, liquid crystal display (LCD) for the exclusive purpose of illustrating the input data being added to the copy of the original document. The LCD display is also programmed to provide step by step instructions for using the edit pad. Other suitable displays are cathode ray tubes (CRT). Memory key 22 is an erasable programmable, read only memory. By way of example, a 16K bit chip may be used to store the information to be used to program the operations of the printing machine. Inorder to produce a color highlighted copy of the original document, the operator employs stylus 32 to initially select color highlighting in menu selection area 28. Thereafter, the operator selects the coordinates of the original document 34 to be reproduced in the highlight color. For example, the operator can select various blocks, i.e. blocks A and B, of text to be reproduced in the highlight color by using stylus 32. The coordinates of the color highlighted blocks are either transmitted directly to control panel 14 of printing machine 10 or stored in key 22. After the highlight coordinate information has been been transmitted to printing machine 10, original document 34 is placed on the platen of the printing machine either by recirculating document handler 12 or manually by the operator. A suitable edit pad of the type described herein is disclosed in U.S. patent application Ser. No. 861,891 filed May 12, 1986, now abandoned, the relevant parts thereof being hereby incorporated into the present application by reference thereto.

Figure 2:
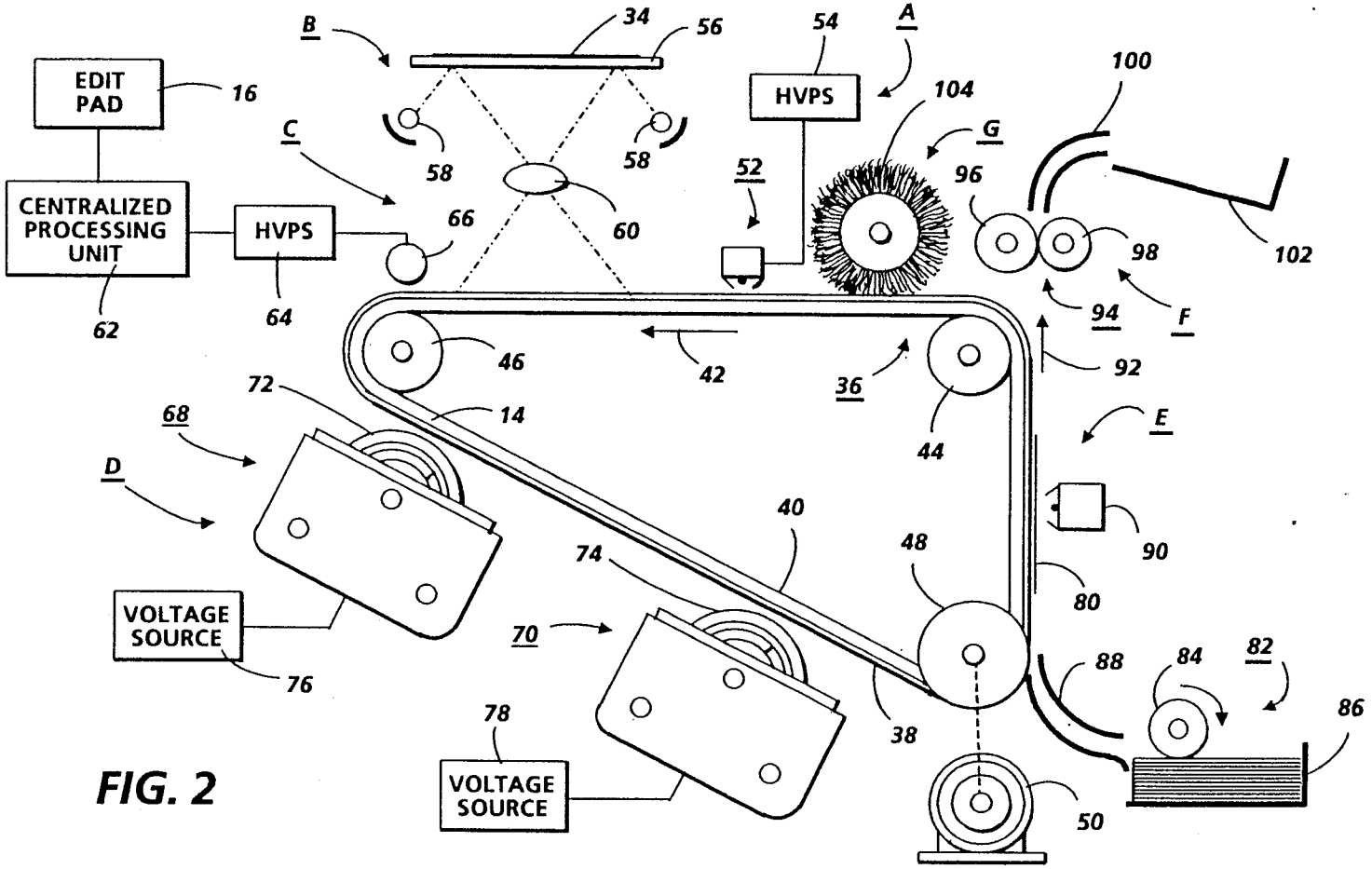
FIG. 2 is a schematic elevational view of one embodiment of the FIG. 1 copying system.

Turning now to FIG. 2, there is shown one embodiment of electrophotographic printing machine 10. Electrophotographic printing machine 10 employs a belt 36 having a photoconductive surface 38 deposited on a conductive substrate 40. Preferably, photoconductive surface 38 is made from a selenium alloy. Conductive substrate 40 is made preferably from an aluminum alloy which is electrically grounded. Belt 36 moves in the direction of arrow 42 to advance successive portions of photoconductive surface 38 sequentially through the various processing stations disposed about the path of movement thereof. Belt 36 is entrained about stripping roller 44, tensioning roller 46 and drive roller 48. Drive roller 48 is mounted rotatably, in engagement with belt 36. Motor 50 rotates roller 48 to advance belt 36 in the direction of arrow 42. Roller 48 is coupled to motor 50 by suitable means, such as a drive belt. Belt 36 is maintained in tension by a pair of springs (not shown) resiliently urging tensioning roller 46 against belt 36 with the desired spring force. Stripping roller 44 and tensioning roller 46 are mounted to rotate freely.

Initially, a portion of belt 10 passes through charging station A. At charging station A, a corona generating device, indicated generally by the reference numeral 52 charges photoconductive surface 36 to a relatively high, substantially uniform potential. High voltage power supply 54 is coupled to corona generating device 52. Excitation of power supply 54 causes corona generating device 52 to charge photoconductive surface 38 of belt 36. After photoconductive surface 38 of belt 36 is charged, the charged portion thereof is advanced through exposure station B.

At exposure station B, original document 34 is placed face down upon a transparent platen 56. Lamps 58 flash light rays onto original document 34. The light rays reflected from original document 34 are transmitted through lens 60 to form a light image thereof. Lens 60 focuses this light image onto the charged portion of photoconductive surface 38 to selectively dissipate the charge thereon. This records an electrostatic latent image on photoconductive surface 38 which corresponds to the informational areas contained within original document 34.

After the electrostatic latent image has been recorded on photoconductive surface 12, belt 10 advances the latent image to highlight color station C. At highlight color station C, the intensity of the charge level of the portion of the copy to be reproduced in the highlight color is adjusted. For example, during exposure, the background regions of the original document reflects substantially all of the light rays so as to discharge the charge on the photoconductive surface to a charge level of about 100 volts while the black text substantially absorbs all of the light rays so that the charge level of the text regions remains at about 1000 volts. At highlight color station C, the charge level of the selected portions of the information or text is reduced to an intermediate charge level between the background charge level and the charge level of the black text or information, i.e. to about 550 volts. The is achieved by using the coordinate information transmitted from edit pad 16 to the centralized processing unit 62 of control panel 14. As shown in FIG. 1, the operator selects the highlight color block of overlay menu 28 of edit pad 16 with stylus 32. This defines specific positional coordinates which actuate the logic control of the centralized processing unit 62 of control panel 14 to perform specific operations within the printing machine. When it is desired to reproduce a color highlighted color copy, stylus 32 is positioned in contact with the highlight color block of overlay menu 28. The digitizing area transmits a signal indicating that the copy sheet is to have color highlighting. The information desired to be reproduced in highlight color is selected and the positional coordinates thereof are also identified by the digitizing area. Thus, the digitizing area transmits a signal defining the positional coordinates of the information desired to be color highlighted on the copy and the operation to be performed on the copy, i.e. color highlighting. After the signal corresponding to positional coordinates are received from the edit pad by the centralized processing unit, the charge level of the highlight color regions is reduced. This is achieved by energizing a high voltage power supply 64 actuating a light emitting diode array (LED) to reduce the charge level of the selected portions of the original document from the copy sheet. This is achieved by illuminating selected portions of the charge level of the text, the electrostatic latent image, at a lower intensity than the illumination furnished by lamps 58. In this way, the charge level of the selected highlight color regions is set at an intermediate level between the charge level of the background and the charge level of the black information, e.g. about 550 volts. Thus, the photoconductive surface now has an electrostatic latent image recorded thereon having a plurality of charge levels, i.e. 1000 volts corresponding to the black information, 550 volts corresponding to the highlight color information and 100 volts corresponding to the background regions. This latent image is advanced by the movement of belt 36 in the direction of arrow 42 to development station D.

Development station D includes two developer units indicated generally by the reference numerals 68 and 70, respectively. Developer unit 68 is adapted to develop the electrostatic latent image with red developer material. Developer unit 70 is adapted to develop the portions of the electrostatic latent image other than the highlight color portions with black developer material. Each developer unit includes a magnetic brush developer roller 72 and 74, respectively. High voltage power supply 76 electrically biases developer roller 72 to a voltage level less than the charge levels of the black information and the highlight color information, e.g. about 350 volts. High voltage power supply 78 electrically biases developer roller 74 to a voltage level intermediate the charge levels of the black information and the highlight color information, e.g. about 800 volts. Each roller advances developer material into contact with the latent image. These developer rollers form a brush of carrier granules having toner particles adhering triboelectrically thereto and extending outwardly therefrom. The charge level of the regions of the latent image greater than the electrical bias on developer roller 72 attract toner particles from the carrier granules forming a toner powder image thereon. Inasmuch as both the black regions and the highlight color regions have a greater charge level than the electrical bias applied to developer roller 72, red toner particles are attracted to both the black regions and the highlight color regions. The charge level of the regions of the latent image greater than the electrical bias on developer roller 74 attract toner particles from the carrier granules forming a toner powder image thereon. Inasmuch as only the black regions have a greater charge level than the electrical bias applied to developer roller 7, black toner particles are attracted to black regions in superimposed registration with the red toner particles previously developer thereon. Thus, the latent image has the highlight color regions developed with red toner particles while the remainder thereof is developed with black toner particles and red toner particles. Inasmuch as the black toner particles absorb light, the observer sees a copy having black regions and red regions, i.e. a copy having portions color highlighted. Developer units 68 and 70 are identical to one another, the only difference being the color of the toner particles contained therein. Developer unit 68 uses red toner particles while developer unit 70 uses black toner particles. Each developer roller includes a substantially stationary cylindrical magnet having magnetic poles impressed about at least a portion of the circumferential surface thereof with a rotating sleeve disposed thereabout. The developer rollers are located in the chamber of a developer housing. The chamber of each developer housing stores a supply of developer material therein. Each developer roller is mounted in the chamber of its' respective housing so as to advance developer material therefrom to the latent image recorded on the photoconductive surface of belt 36. Further details of the development process will be discussed hereinafter with reference to FIGS. 4 and 5.

With continued reference to FIG. 2, after the latent image is developed simultaneously with red and black toner particles, the resultant toner powder image is advanced on belt 36 to transfer station E. A copy sheet 80 is advanced to transfer station E by sheet feeding apparatus 82. Preferably, sheet feeding apparatus 82 includes a feed roll 84 contacting the uppermost sheet of stack 86. Feed roll 84 rotates to advance the uppermost sheet from stack 86 into chute 88. Chute 88 directs the advancing sheet of support material into contact with photoconductive surface 38 of belt 36 in a timed sequence so that the toner powder image formed thereon contacts the advancing sheet at transfer station E. Transfer station E includes a corona generating device 90 which sprays ions onto the back side of sheet 80. This attracts the toner powder image from photoconductive surface 38 to sheet 80. After transfer, sheet 80 continues to move in the direction of arrow 92 onto a conveyor (not shown) which advances sheet 80 to fusing station F.

Fusing station F includes a fuser assembly, indicated generally by the reference numeral 94, which permanently affixes the transferred powder image to sheet 80. Fuser assembly 94 includes a heated fuser roller 96 and a back-up roller 98. Sheet 80 passes between fuser roller 96 and back-up roller 98 with the toner powder image contacting fuser roller 96. In this manner, the toner powder image is permanently affixed to sheet 80. After fusing, sheet 80 advances through chute 100 to catch tray 102 for subsequent removal from the printing machine by the operator.

After the copy sheet is separated from photoconductive surface 36 of belt 38, the residual toner particles adhering to photoconductive surface 38 are removed therefrom at cleaning station G. Cleaning station F includes a rotatably mounted fibrous brush 104 in contact with photoconductive surface 38. The particles are cleaned from photoconductive surface 38 by the rotation of brush 104 in contact therewith. Subsequent to cleaning, a discharge lamp (not shown) floods photoconductive surface 38 with light to dissipate any residual electrostatic charge remaining thereon prior to the charging thereof for the next successive imaging cycle.

Figure 3:
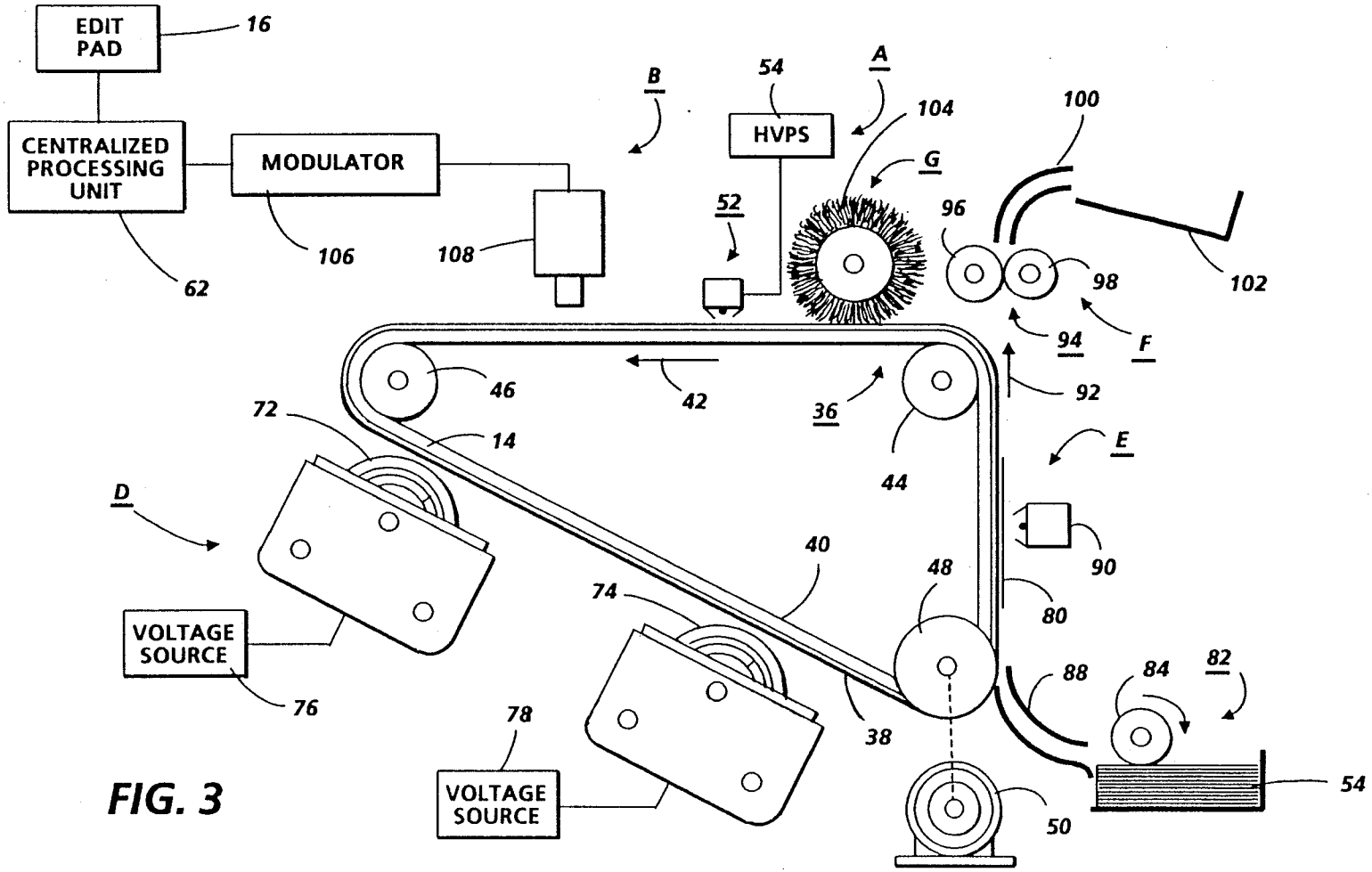
FIG. 3 is a schematic elevational view of another embodiment of the FIG. 1 copying system.

Referring now to FIG. 3, there is shown another embodiment of electrophotographic printing machine 10. The only distinction between embodiment of the printing machine illustrated in FIG. 2 and that shown in FIG. 3, is that the FIG. 3 printing machine employs a laser imaging station B in lieu of exposure station B and color highlighting station C. Laser imaging station B selectively discharges the charged region of photoconductive surface so as to record an electrostatic latent image having a plurality of charge levels, i.e. 1000 volts for the black information, 550 volts for the highlight color information and 100 volts for the background areas. This is accomplished by edit pad 16 transmitting a signal to centralized processing unit 62 of control panel 14. The centralized processing unit controls modulator 106. The intensity of the laser beam is reduced in the regions of highlight color. In this way, the scanning beam discharges the photoconductive surface to a level intermediate that of the black regions and the background regions. A suitable intensity controlled laser unit is described in U.S. Pat. No. 4,727,382 issued in 1988 to Negishi et al., the relevant portions thereof being hereby incorporated into the present application by reference thereto. After the electrostatic latent image having different charge levels thereon is recorded on the photoconductive surface, it is developed with toner particles to form a toner powder image. The toner powder image is then transferred to the copy sheet and fused thereto. As previously indicated, the steps of charging, developing, transferring, fusing and cleaning are identical for the embodiments depicted in FIGS. 2 and 3.

Figure 4:
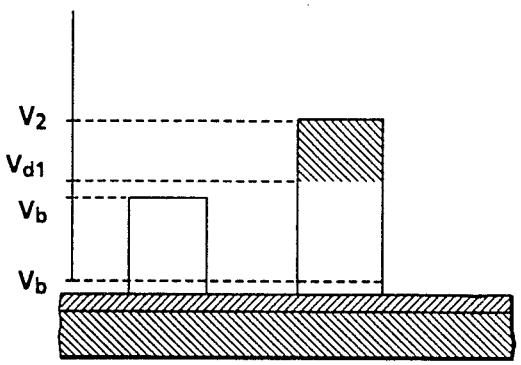
FIG. 4 is a graphical representation depicting the charge levels during development of one color by the electrophotographic printing machine.

Turning now to FIG. 4, there is shown a graphical representation of development of the black regions of the latent image. The charge level $V_2$ represents the voltage recorded on the photoconductive surface for the black regions. The charge level $V_1$ represents the voltage recorded on the photoconductive surface for the red regions. $V_b$ represents the charge level of the background. $V_{d1}$ represents the electrical bias applied by voltage source 76 on developer roller 72. As shown, $V_2$ is greater than $V_{d1}$. Thus, the regions of the latent image having a charge level of $V_2$ will attract the black toner particles thereto. However, $V_{d1}$ is greater than $V_1$. Thus, the regions of the latent image having a charge level of $V_1$ will not attract the black toner particles thereto. In this way, only the regions of the latent image desired to be developed in black are developed in black.

Figure 5:
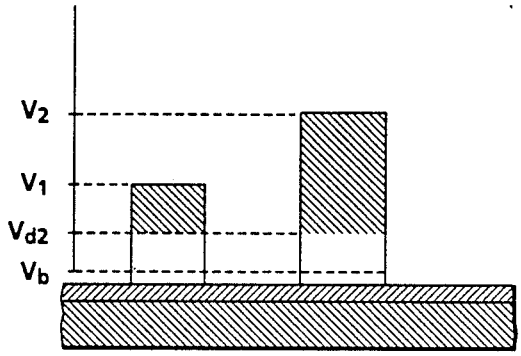
FIG. 5 is a graphical representation depicting the charge levels during development of another color by the electrophotographic printing machine.

Turning now to FIG. 5, there is shown a graphical representation of development of the latent image with red toner particles. Once again, the charge level $V_2$ represents the voltage recorded on the photoconductive surface for the black regions. The charge level $V_1$ represents the voltage recorded on the photoconductive surface for the red regions. $V_b$ represents the charge level of the background. $V_{d2}$ represents the electrical bias applied by voltage source 78 on developer roller 74. As shown, $V_2$ is greater than $V_{d2}$. Thus, the regions of the latent image having a charge level of $V_2$ will attract the red toner particles thereto. However, black toner particles have been deposited in this region as described with reference to FIG. 4. Thus, both red and black toner particles are deposited in this region. $V_1$ is greater than $V_{d2}$. Thus, the regions of the latent image having a charge level of $V_1$ will also attract the red toner particles thereto. In this way, the regions of the latent image desired to be developed in red are developed with red toner particles. Those regions of the latent image having both the red and black toner particles developed thereon appear to be black since the black toner particles are much darker than the red toner particles and absorb light. Thus, the user of the copy sheet only perceives a copy having red and black regions thereon. U.S. Pat. No. 3,702,483 issued to Fantuzzo in 1972 describes the foregoing process in greater detail, the relevant portions thereof being hereby incorporated into the present application.

One skilled in the art will appreciate that the developer material employed herein is not limited to black and red toner particles but that any toner particles of lighter and darker colorants may be employed. Moreover, one skilled in the art will further appreciate that the developer materials employed may be liquid inks having lighter and darker colorants in lieu of dry developer materials using carrier granules having toner particles adhering triboelectrically thereto.

In recapitulation, it is clear that the copy system of the present invention employs an edit pad to select the areas of a copy to be reproduced in a highlight color. This information is used to record an electrostatic latent image on a photoconductive surface having a plurality of charge levels. The different charge levels in the latent image are developed simultaneous by developer materials having lighter and darker colorants so as to form a color highlighted developed image in a single operating cycle. The developed image is then transferred to the copy sheet and fused thereto forming a copy having the regions selected by the edit pad reproduced in a highlight color.

It is, therefore, evident that there has been provided in accordance with the present invention, a printing system which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. A copy system, including:

input means for inputting a color highlighting condition for image editing;

a copying machine;

means for coupling said input means to said copying machine; and image forming means installed in said copying machine and for forming a copy image of an original being edited in accordance with the color highlighting condition so that the copy image has a plurality of different charge levels with a first charge level corresponding to a first region of the copy image to be developed with developer material of a first color and a second charge level corresponding to a second region of the copy image to be developed with developer material of a second color, said image forming means comprises a photoconductive member, means for charging said photoconductive member to a substantially uniform charge level, means, responsive to said inputting means, for exposing the charged portion of said photoconductive member to record the electrostatic latent image on said photoconductive member having the plurality of different charge levels, said exposing means comprises means for projecting a light image of the original being edited, and means, responsive to said inputting means, for adjusting the intensity of the light image so that the light image has a plurality of different intensities with a first intensity level corresponding to the first region of the copy image to be developed with developer material of the first color and a second intensity level corresponding to the second region of the copy image to be developed with developer material of the second color.

2. A copy system, including:

input means for inputting a color highlighting condition for image editing;

a copying machine;

means for coupling said input means to said copying machine; and image forming means installed in said copying machine and for forming a copy image of an original being edited in accordance with the color highlighting condition so that the copy image has a plurality of different charge levels with a first charge level corresponding to a first region of the copy image to be developed with developer material of a first color and a second charge level corresponding to a second region of the copy image to be developed with developer material of a second color, said image forming means comprises a photoconductive member, means for charging said photoconductive member to a substantially uniform charge level, means for projecting a light image of the original being edited onto the charged portion of said photoconductive member to record an electrostatic latent image thereon, and means, responsive to said inputting means, for adjusting the charge levels of the electrostatic latent image so that the electrostatic latent image has a plurality of different charge levels with the first charge level corresponding to the first region of the copy image to be developed with developer material of the first color and the second charge level corresponding to the second region of the copy image to be developed with developer material of the second color.

3. A copy system according to claim 2, wherein said adjusting means includes means for discharging selected portions of the electrostatic latent image recorded on said photoconductive member so that the electrostatic latent image has a plurality of different charge levels with the first charge level corresponding to the first region of the copy image to be developed with developer material of the first color and the second charge level corresponding to the second region of the copy image to be developed with developer material of the second color.

4. A copy system according to claim 3, wherein said discharging means includes means for illuminating selected portions of the electrostatic latent image to adjust the charge levels thereof.

5. A copy system according to claim 4, further including means, installed in said copying machine, for developing the first charge level of the electrostatic latent image with the first color developer material and the second charge level of the electrostatic latent image with the second color developer material.

6. A copy system according to claim 5, further including:

means, installed in said copying machine, for transferring the first color developer material and the second color developer material to a copy sheet; and means, installed in said copying machine, for fusing the first color developer material and the second color developer material to the copy sheet forming a copy of the original having the color highlighting condition.

7. A copy system according to claim 6, wherein said input means includes:

a tablet on which the original is placed; and an input pen for designating portions of the original for editing for the color highlighting condition by contacting said tablet.

8. A copy system according to claim 4, further including:

a storage medium adapted to be attachably/detachably attached to said input means for storing the designated portions of the original for editing for the color highlighting condition; and a storage medium receiving portion formed on said copying machine, said storage medium being adapted to be attachably/detachably attached to said storage medium receiving portion for transmitting the designated portions of the original for editing for the color highlighting condition to said copying machine.

9. A copy system according to claim 8, wherein said storage medium includes a readable/writable memory.

10. An apparatus for producing a color highlighted copy of an original document; including:

means for reproducing copies of an original document;

means, located remotely from said reproducing means, for designating selected portions of the original document to be color highlighted and generating a signal indicative of the portions of the original document to be color highlighted; and means, mounted in said reproducing means, for forming a latent image of the original document, said forming means being responsive to the signal from said designating means so that the latent image has at least two charge levels with a first charge level corresponding to a first region of the latent image to be developed with developer material of a first color and a second charge level corresponding to a second region of the latent image to be developed with developer material of a second color, said forming means comprises a photoconductive member, means for charging said photoconductive member to a substantially uniform charge level, means for projecting a light image of the original document onto the charged portion of said photoconductive member, and means, responsive to said designating means, for adjusting the intensity of the light image so that the light image has a plurality of different intensities with a first intensity level corresponding to the first region of the electrostatic latent image to be developed with developer material of the first color and a second intensity level corresponding to the second region of the latent image to be developed with developer material of the second color.

11. An apparatus according to claim 10, wherein said adjusting means includes means for discharging selected portions of the electrostatic latent image recorded on said photoconductive member so that the electrostatic latent image has at least the first charge level and the second charge level.

12. An apparatus according to claim 11, wherein said discharging means includes means for illuminating selected portions of the electrostatic latent image to adjust the charge levels thereof.

13. A copy system according to claim 12, further including means, mounted in said reproducing means, for developing the first charge level of the electrostatic latent image with the first color developer material and the second charge level of the electrostatic latent image with the second color developer material.

14. An apparatus according to claim 13, further including:

means, mounted in said reproducing machine, for transferring the first color developer material and the second color developer material to a copy sheet; and means, mounted in said reproducing machine, for fusing the first color developer material and the second color developer material to the copy sheet forming a color highlighted copy of the original document.

15. An apparatus according to claim 14, wherein said designating means includes:

a tablet on which the original is placed; and an input pen for selecting portions of the original document to be color highlighted by contacting said tablet.

16. An apparatus according to claim 15, further including means, attachably/detachably attached to said designating means, for storing the:

means, adapted to be attachably/detachably attached to said designating means, for storing the selected portions of the original document to be color highlighted; and a receiving portion formed on said reproducing means, said storing means being adapted to be attachably/detachably attached to said receiving portion for transmitting the selected portions of the original document to be color highlighted to said reproducing means.

17. An apparatus according to claim 16, wherein said storing means includes a readable/writable memory.

* * * * *